US007424750B2

(12) United States Patent
Kerr

(10) Patent No.: US 7,424,750 B2
(45) Date of Patent: Sep. 16, 2008

(54) HOSPITAL GOWN WITH ENHANCED PRIVACY FEATURES

(76) Inventor: Brian C. Kerr, 252 W. Meadow Ridge La., Eagle, ID (US) 83616-3865

( * ) Notice: Subject to any disclaimer, the term of this patent is extended or adjusted under 35 U.S.C. 154(b) by 63 days.

(21) Appl. No.: 11/152,622

(22) Filed: Jun. 13, 2005

(65) Prior Publication Data

US 2006/0277655 A1 Dec. 14, 2006

(51) Int. Cl.
*A41D 10/00* (2006.01)

(52) U.S. Cl. ..... 2/114

(58) Field of Classification Search ..... 2/77, 2/114, 113, 115, 50, 52, 51, 48, 88, 104, 2/901, 75, 80, 111
See application file for complete search history.

(56) References Cited

U.S. PATENT DOCUMENTS

| | | | | | |
|---|---|---|---|---|---|
| 1,497,685 | A | * | 6/1924 | Hoyme | 2/67 |
| 2,443,102 | A | * | 6/1948 | Friedman | 2/114 |
| 2,628,359 | A | * | 2/1953 | Shalda | 2/71 |
| 2,717,390 | A | * | 9/1955 | Houze | 2/74 |
| 2,803,825 | A | * | 8/1957 | Schiek | 2/75 |
| 3,230,546 | A | * | 1/1966 | Sabee | 2/114 |
| 3,824,625 | A | | 7/1974 | Green | |
| 4,215,434 | A | | 8/1980 | Barron | |
| 4,524,463 | A | | 6/1985 | Ogden | |
| 4,570,268 | A | * | 2/1986 | Freeman | 2/114 |
| 4,578,825 | A | | 4/1986 | Vote | |
| 4,764,985 | A | * | 8/1988 | Wade | 2/88 |
| 4,837,863 | A | * | 6/1989 | Van Scoy-Mosher | 2/114 |
| 4,864,657 | A | * | 9/1989 | Lake | 2/114 |
| 4,920,578 | A | * | 5/1990 | Janzen et al. | 2/114 |
| 4,964,173 | A | * | 10/1990 | Gordon et al. | 2/114 |
| 4,975,984 | A | * | 12/1990 | Sting | 2/114 |
| 5,050,243 | A | | 9/1991 | Udell | |
| 5,062,159 | A | | 11/1991 | Jakub | |
| 5,150,477 | A | * | 9/1992 | Elberson et al. | 2/114 |
| 5,228,141 | A | | 7/1993 | Remsky et al. | |
| 5,440,763 | A | * | 8/1995 | Shah et al. | 2/114 |
| 5,564,123 | A | * | 10/1996 | Grassick | 2/69 |
| 5,603,123 | A | * | 2/1997 | Chupa | 2/275 |
| 5,799,330 | A | * | 9/1998 | O'Donoghue-Kitt | 2/114 |
| 6,134,715 | A | | 10/2000 | McLennan | |
| 6,240,563 | B1 | * | 6/2001 | Niedermeyer | 2/114 |
| 6,460,187 | B1 | * | 10/2002 | Siegel | 2/114 |
| 6,564,386 | B2 | | 5/2003 | Fujikawa et al. | |
| 6,647,552 | B1 | * | 11/2003 | Hogan | 2/114 |
| 6,694,521 | B1 | * | 2/2004 | Hopkins | 2/83 |
| 2003/0126668 | A1 | * | 7/2003 | Scroggins | 2/114 |

* cited by examiner

*Primary Examiner*—Alissa L Hoey
(74) *Attorney, Agent, or Firm*—Elizabeth Herbst Schierman; Dykas, Shaver & Nipper, LLP

(57) ABSTRACT

A patient gown such as the type utilized in a hospital setting made up of a single one piece front panel section and a single one piece back panel section releaseably connected along a shoulder seam by a plurality of releasable fasteners. The front and back panel sections defining a generally V-shaped neck portion configured to allow passage of a person's head therethrough, and further containing a closure device configured to connect the patient gown around in front of a wearer. These sections connected along a shoulder seam formed by the uniting of the top portions of the front panel section and the back panel section by at least one selectively releasable fastener. The gown has a connection device that is configured to allow opposing portions of the back panel to be connected together in a location in front of the person wearing the device.

17 Claims, 8 Drawing Sheets

HOSPITAL GOWN WITH ENHANCED PRIVACY FEATURES

BACKGROUND OF THE INVENTION

1. Field of the Invention

The present invention generally relates to hospital clothing, and more particularly to a patient hospital gown adapted to provide necessary access to a patient's body while also providing increased privacy, warmth, and comfort to a wearer of the gown.

2. Background Information

Most clothing worn by patients in a hospital and doctor's office setting is designed for the convenience of the medical professionals and not for the convenience of the wearer of the item of clothing. The very nature of the medical profession requires that various persons involved in the diagnosis, treatment and care of a patient have the ability to access various parts of the body of the patients that they are treating and caring for. Thus such a professional must have the ability to access various portions of a person's body so as to be able to perform a variety of functions including performing health assessments, taking vital signs, performing physical examinations, and attaching various required items to the body of a patient. In addition to this access, the placement of items onto or within a patient's body may result in a condition where these items such as an intravenous line or a cardiac monitoring device must extend a designated distance away from the body of the patient. Such devices include intravenous lines, catheters and diagnostic leads for various monitoring systems.

In order to accommodate the medical professionals who perform these various features most prior art patient coverings include large gaping openings which do provide access to the body by a medical professional however, these same large gaping openings also often times cause the body of the person wearing the garment to be left open and exposed. This condition thus limits the limited privacy or warmth to the wearer and results in the wearer of the garment being not only embarrassed but cold as well.

In order to address these issues, a variety of devices have been developed. One of these devices is shown in U.S. Pat. No. 5,050,243 to C. Leland Udell. This device describes a one-piece hospital gown made from a single piece of cloth that has a fastening device intended to connect in the back of the patient's body. Such a gown typically also includes two openings through which a patient extends their arms and which thus covers the front portion of a person's body. The back of the gown, as it is typically called, is generally open. In some instances a single fastening tie is utilized to tie the back of the gown together.

This device has several problems. First, while such a gown does cover a desired portion of the front side of a person's body, such a device generally leaves the back portion of a person's body open to plain view. The single tie which is attached to the device and which is intended to hold the sides of the device about the back portion of the person's body, is positioned in such a location that it is difficult for the wearer to tie. Thus, the closing of the back portion of the device is generally difficult and awkward. Even when such a connection is made, this connection is typically insufficient to adequately hold the rear portions of the gown together and as a result, the gown can be opened when a person engages in any of a variety of activities, including standing, sitting, bending over, or walking.

The large resulting opening that exists in the back portion of the gown is not desired by the wearer because it is uncomfortable, cold, and provides potential embarrassment, particularly to parties who seek as a matter of personal preference, to cover substantial portions of their body. Many times a party who wears one of these devices will attempt to hold the back portion of the gown closed while they move about so as to prevent the gown from opening. This is therefore a further hindrance to a wearer of the prior art gown because this creates an awkward and potentially embarrassing situation to the wearer, as the back of the gown may come open and expose more of the patient's body than they are comfortable showing.

These prior art devices also are of limited utility to the medical professionals because while these gowns do allow for access to the rear portion of a patient's body, such a gown also requires that all or a portion of the gown be removed in order to access the front portion of a patient's body. Thus, in a typical hospital situation, routine medical procedures such as placing leads for an electrocardiogram may require the movement of the patient so as to disconnect or unfasten the connection portion of the prior art covering so as to access the chest of the patient or such an action may require that the entire robe be lifted up and placed around the patient's face so as to have access to the patient's chest.

In addition to these problems, these types of hospital gowns also cause a variety of other problems as well. One of these problems is that the closing of the gown around the posterior portion of a patient causes portions of the gown to bunch into an uncomfortable wad behind a patient's back. This wad is not only uncomfortable to the patient, but can in some circumstances place the wearer at an increased risk for nerve damage or pressure sores as a result of this gown configuration. To avoid these problems patients are in many instances partially disrobed during the transfer process, this in many instances adds to the anxiety felt by the patients as they under go this process.

Another problem with the previously described gown design and other designs which wrap around a patient's body is that the after a patent is under general anesthesia the body weight of the patient makes removal of the gown very difficult, therefore in many circumstances, the gown is simply cut away, or the closure tabs on the gown are cut, thus rendering these gowns unusable for future patients.

A variety of other type of prior art devices have also been developed in an attempt to provide a patient gown with increased privacy, while still providing sufficient easy access to the body of the wearer of the gown. However, this has proved to be a difficult balance to be arrived at. Simply closing up the back of a typical hospital gown would provide increased privacy, however, it would limit the potential for access to a medical professional and this is unsuitable. In most prior art devices the more fitted that a gown or other such covering is, the less suitable for use in a hospital setting it is. Furthermore, the more individualized an article of clothing is, the greater cost for stocking, cleaning and tracking of these items. In such a circumstance, a professional would also be required to carry additional sizes to accommodate persons of various sizes. Furthermore, the greater number of parts that are incorporated into the gown, the greater the risk that a portion of a gown would be lost or mismatched. This results in an undesired level of complexity by the hospital personnel who must wash and keep track of all of these articles of clothing, as well as increased costs on the part of the health care facility due to increased number of pieces that could be potentially lost or damaged.

Typically among the prior art devices, the more private a gown can be made, the potentially more difficult such a device is to be placed and removed and the more difficult it is to obtain access to a patients' body. This access is required to perform a simple function such as bathing a person and is essential in the circumstance where life saving services are required to be performed. Also in the prior art, the positioning of various closing devices has been such that the connection of these devices is almost always awkward or impossible, thus making the placing and removing of such a device by the wearer extremely difficult.

Therefore what is needed is a hospital gown that provides adequate access to portions of a patient's body while simultaneously providing sufficient body covering so as to provide a wearer with comfort and warmth. What is also needed is a replaceable garment that provides a wearer with comfort and warmth, allows for access by medical personnel, and fastens in a location that is accessible by the wearer of the garment. What is also needed is a hospital gown that covers the back portion of a wearer, allows the wearer to close the device and allows medical personnel sufficient access when necessary to the portions of the wearer's body. In addition to the concerns of the medical professional and the patient, the gown that is used in a medical setting must also be easily washable and sterilizable so as to be worn by various persons. In such an arrangement multiple pieces that may be easily lost or mismatched are undesired. Additionally, limited numbers of sizes of dressings must also be provided for simplicity in organization while still being able to adequately clothe a variety of persons having multiple different sizes and shapes.

Accordingly, it is an object of the present invention to provide a hospital gown that provides adequate access to portions of a patient's body while simultaneously providing sufficient body covering so as to provide a wearer with comfort and warmth. Another object of the invention is to provide a replaceable garment that provides a wearer with comfort and warmth, allows for access by medical personnel, and fastens in a location that is accessible by the wearer of the garment. Another object of the invention is to provide a hospital gown that covers the back portion of a wearer, allows the wearer to close the device and allows medical personnel access through the garment to the portions of the wearer's body.

Additional objects, advantages and novel features of the invention will be set forth in part in the description which follows and in part will become apparent to those skilled in the art upon examination of the following or may be learned by practice of the invention. The objects and advantages of the invention may be realized and attained by means of the instrumentalities and combinations particularly pointed out in the appended claims.

SUMMARY OF THE INVENTION

A patient gown such as the type utilized in a hospital setting made up of a front panel section and a back panel section. The front and back panel sections are each made from a flexible material and have a portion configured to allow passage of a person's head through the opening formed when the front and back panel sections are combined. In the preferred embodiment, the opening is in a V-shaped configuration. The front panel section and the back panel sections are connected along a shoulder seam formed by the uniting of the top portions of the front panel section and the back panel section by at least one selectively releasable fastener. The gown also has a connection device formed around its border that allows opposing portions of the back panel to be connected together in a location in front of the person wearing the device.

The sides of the gown between the front and rear panels are generally selectively open so as to allow access to the patient's body through the apertures formed between the connection of the front and back portion of the gown. The back panel is one piece and is configured to wrap around the rear of the person and be connected in the front of the wearer by a connection device. In the preferred embodiment, this back panel has larger dimensions than the front panel and has a pair of ties that allow the back panel to be brought around in front of the person wearing the device and tied in the front. This provides the wearer with increased coverage of the body compared to the other devices found in the prior art. Unlike the prior art devices, when this device is placed upon a wearer, no open portion exists in the rear of the party wearing the device.

The connection of the front and rear panels is accomplished by the connection of releasable fasteners along the upper shoulder margins of the front and rear panels by a series of releasable fasteners. These releasable fasteners allow the top portion of the front panel to be separated and pulled down when access to the person's chest is needed. When this access is no longer necessary reconnecting the releasable fasteners may reconnect the front panel to the back panel.

In the preferred embodiment of the invention these selectively releasable fasteners are hook and loop fasteners, connected to opposing sides of the front and back portions of the device. However, while these types of fasteners are shown in the preferred embodiment, it is to be distinctly understood that the invention is not limited thereto but may be variously embodied to include a variety of other types of releasable connection type of devices. Examples of such devices include snap fit closures, latches, buttons and other types of devices. In one embodiment, the shoulder seam is connected by at least six releasable fasteners. In addition to the connection of the front and rear panels along the shoulder seams, the margins of the front and rear panels can also be connected along the lateral edges of the device by releasable fasteners. Furthermore, depending upon the necessity of a user, the front and rear panels may be configured as to provide sleeves to a wearer.

The present invention provides several advantages over the devices that are shown in the prior art. First, the present invention includes a one-piece back panel, which prevents the unwanted exposure that is common in the prior art. Second, the present invention allows that one-piece back panel to wrap around the rear portion of the person wearing the device so as to cover. This increases the privacy and convenience to the user and is further enhanced by the connection of the two ends of the device by the connection device. In as much as this connection device is configured to connect in front of the person wearing the present invention, this greatly enhances the convenience of the present invention as compared to the prior art. Thirdly, the present invention presents a significant advantage over the prior art because the present invention allows for increased ease of access by medical personnel to the front torso of a wearer because the present invention allows the front panel to be simply pulled down and thus disconnected from the back panel portion of the device. When the need to have open access to the upper torso portion of the patient has passed, this front panel may then be reattached to the back portion along the shoulder seams by means of the selectively releasable fasteners.

In the preferred embodiment of the invention, the front panel and the rear panel of the device are made of two different colored pieces of material and the shoulder seams of the front and rear portions are configured to overlap so as to completely cover the shoulder of the patient wearing the device. This configuration provides increased coverage to the person wearing the invention while the two different colors or patterns marked on the front and back panels allows the pieces to be more easily sorted and maintained by laundry personnel, and worn by a user. In addition, the present invention only comprises two pieces that can become disconnected. In the prior art types of devices, the prior art gowns would have to be untied or otherwise disconnected so as to allow the medical personnel access to the upper portions of the patient's torso. In the present invention this cumbersome necessity has been removed.

The present invention thus allows for increased ease of use as well as increased privacy to a wearer. The present invention allows a wearer to undergo general anesthesia while fully clothed in an operating gown. Once the anesthesia has rendered the patient unconscious, the anterior panel of the gown can be removed thus leaving the patient lying flat upon the posterior panel. If the posterior panel becomes soiled during surgery, a new panel can be placed upon the transferring gurney after the surgery, the patient placed upon the new panel, the old anterior and the new posterior panels combined. This placing and removal of the gown can be performed without any assistance from the patient.

The purpose of the foregoing Abstract is to enable the United States Patent and Trademark Office, the public generally, and especially the scientists, engineers, and practitioners in the art who are not familiar with patent or legal terms or phraseology, to determine quickly from a cursory inspection, the nature and essence of the technical disclosure of the application. The Abstract is neither intended to define the invention of the application, which is measured by the claims, nor is it intended to be limiting as to the scope of the invention in any way.

Still other objects and advantages of the present invention will become readily apparent to those skilled in this art from the following detailed description, wherein I have shown and described only the preferred embodiment of the invention, simply by way of illustration of the best mode contemplated by carrying out my invention. As will be realized, the invention is capable of modification in various obvious respects, all without departing from the invention. Accordingly, the drawings and description of the preferred embodiment are to be regarded as illustrative in nature, and not as restrictive in nature.

DESCRIPTION OF THE PREFERRED EMBODIMENTS

Figure 1:
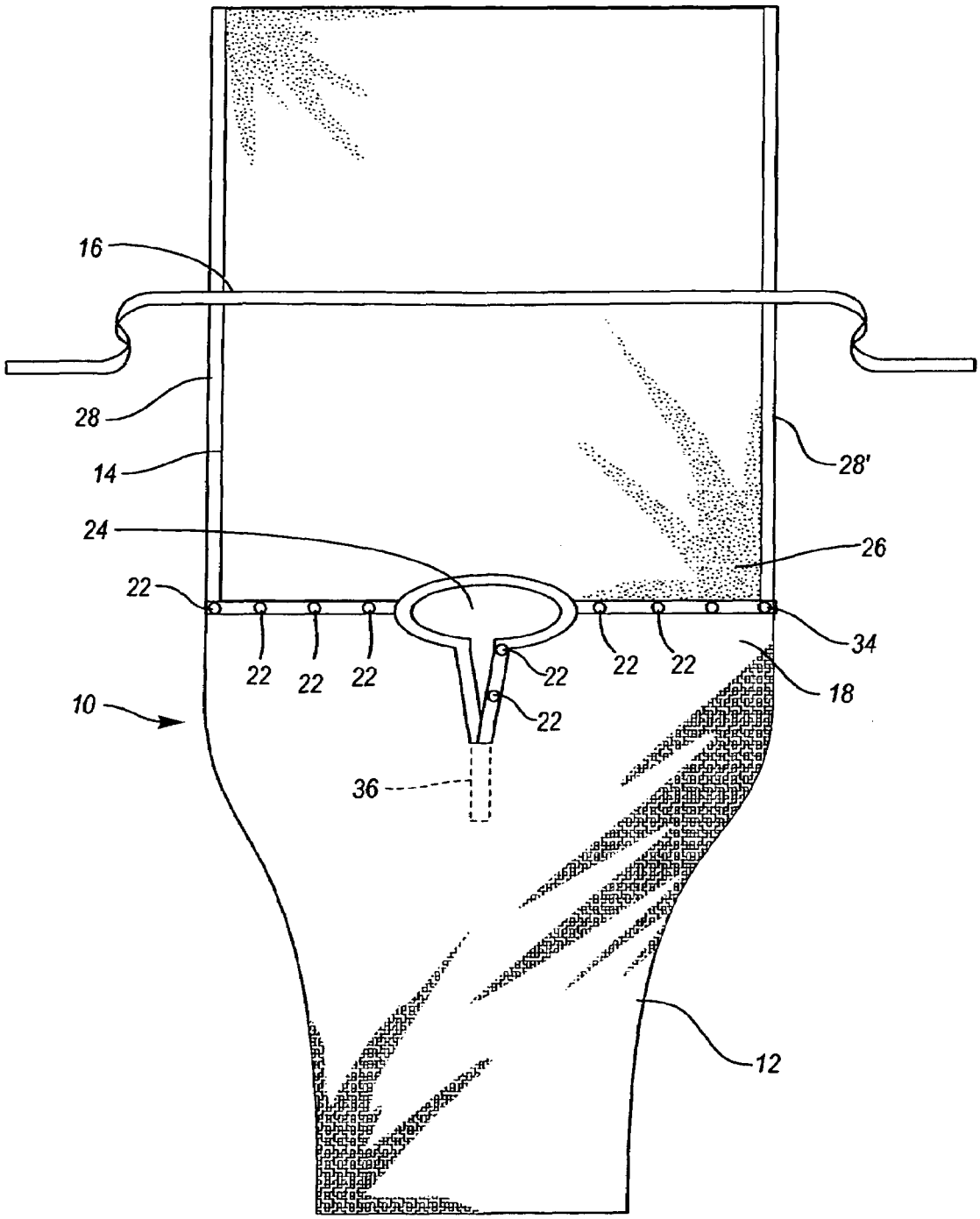
FIG. 1 is a top plan view of the preferred embodiment of the present invention.
Figure 2:
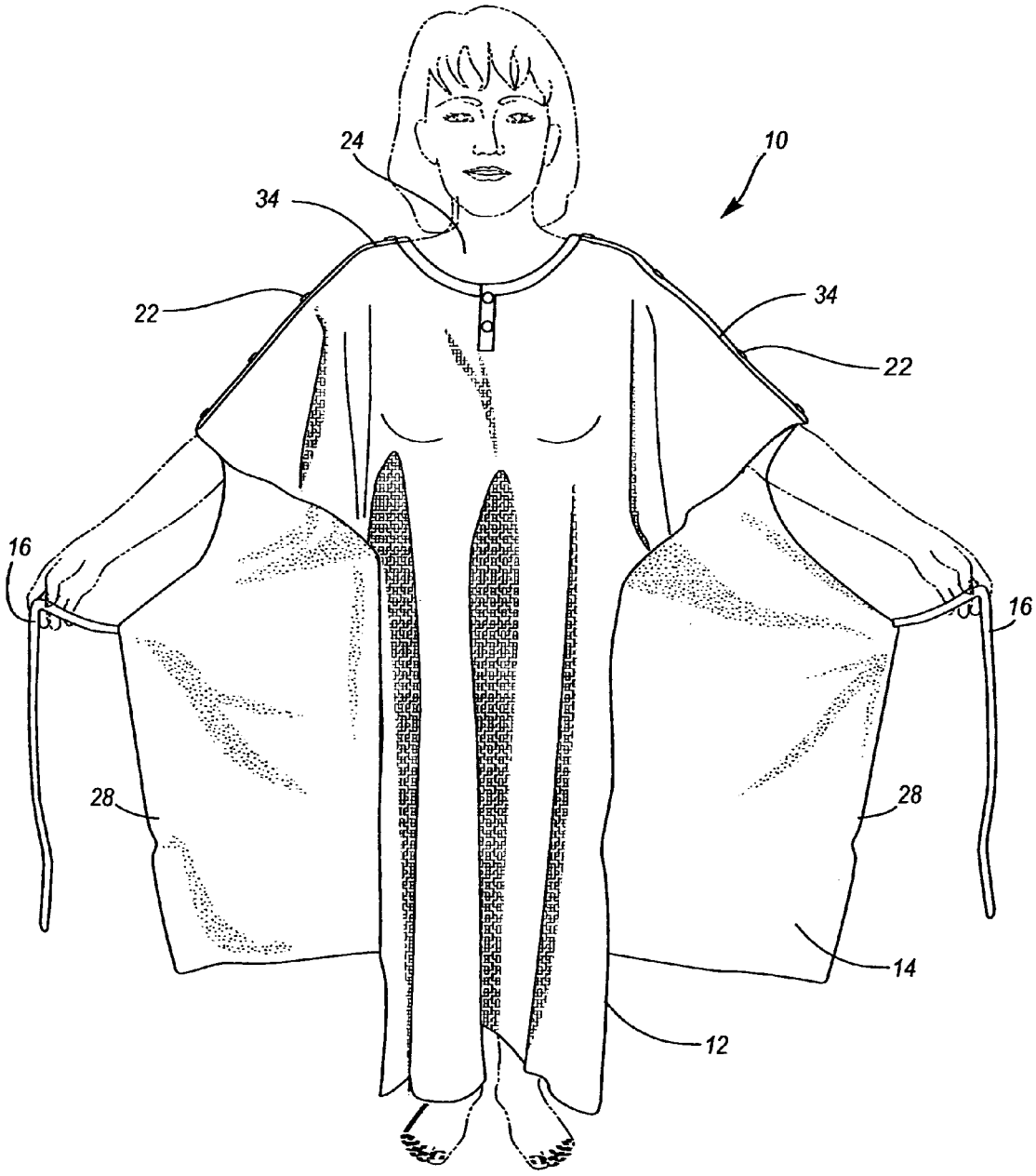
FIG. 2 is a front plan view of the present invention as placed upon a fictional user prior to fastening.
Figure 3:
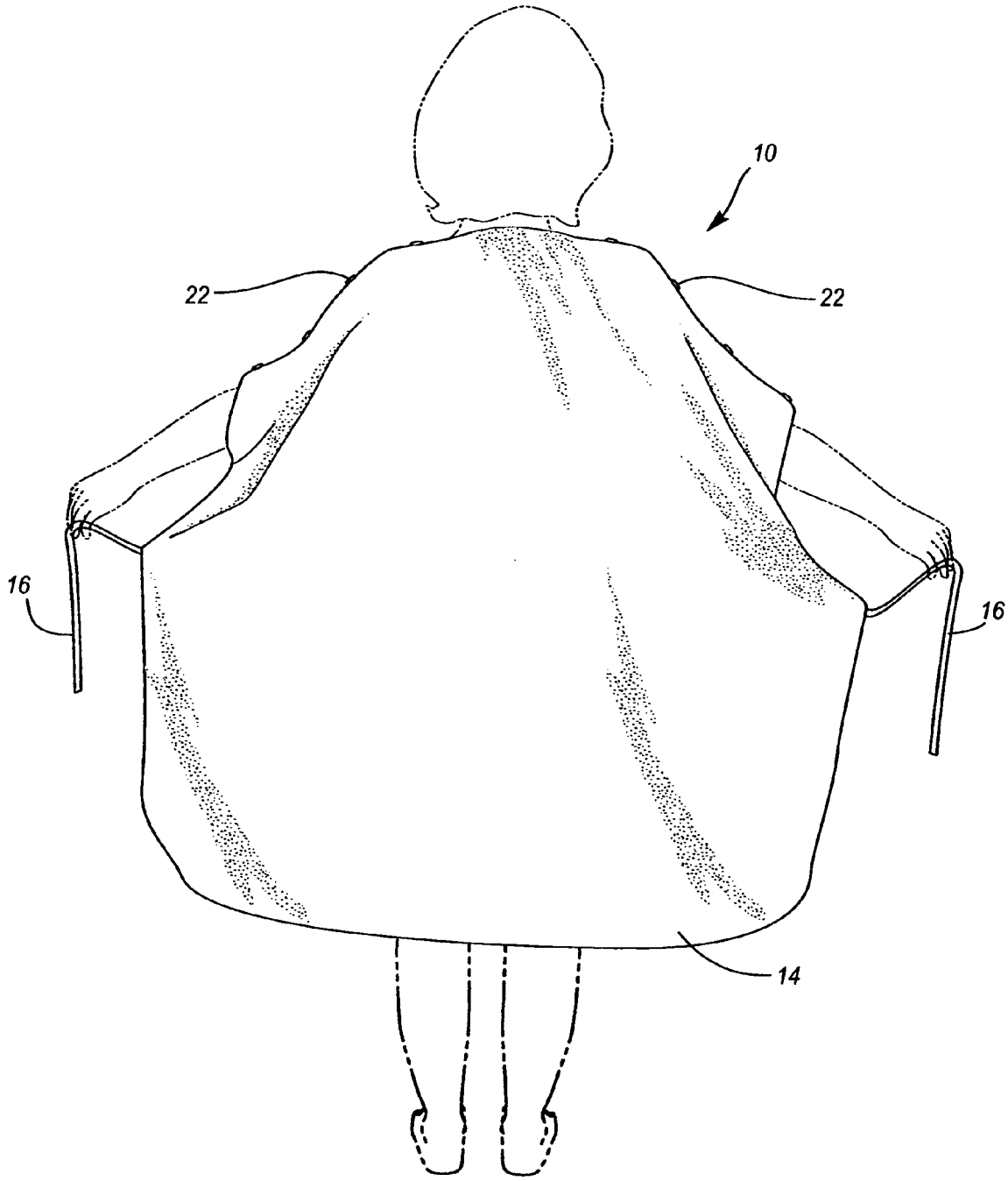
FIG. 3 is a rear plan view of the present invention as placed upon a fictional user prior to fastening.
Figure 4:
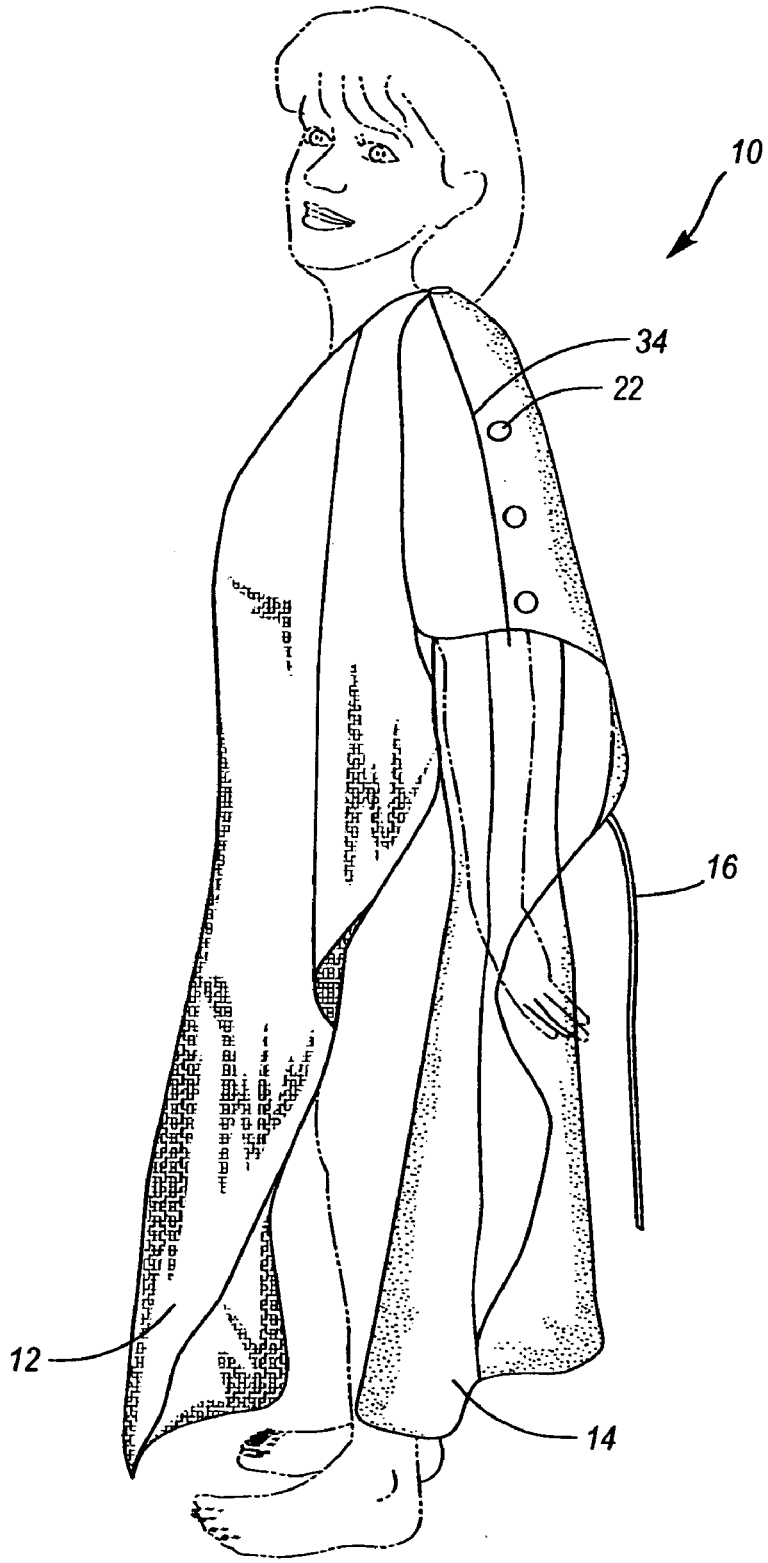
FIG. 4 is a side view of the present invention placed upon a fictional user prior to fastening.
Figure 5:
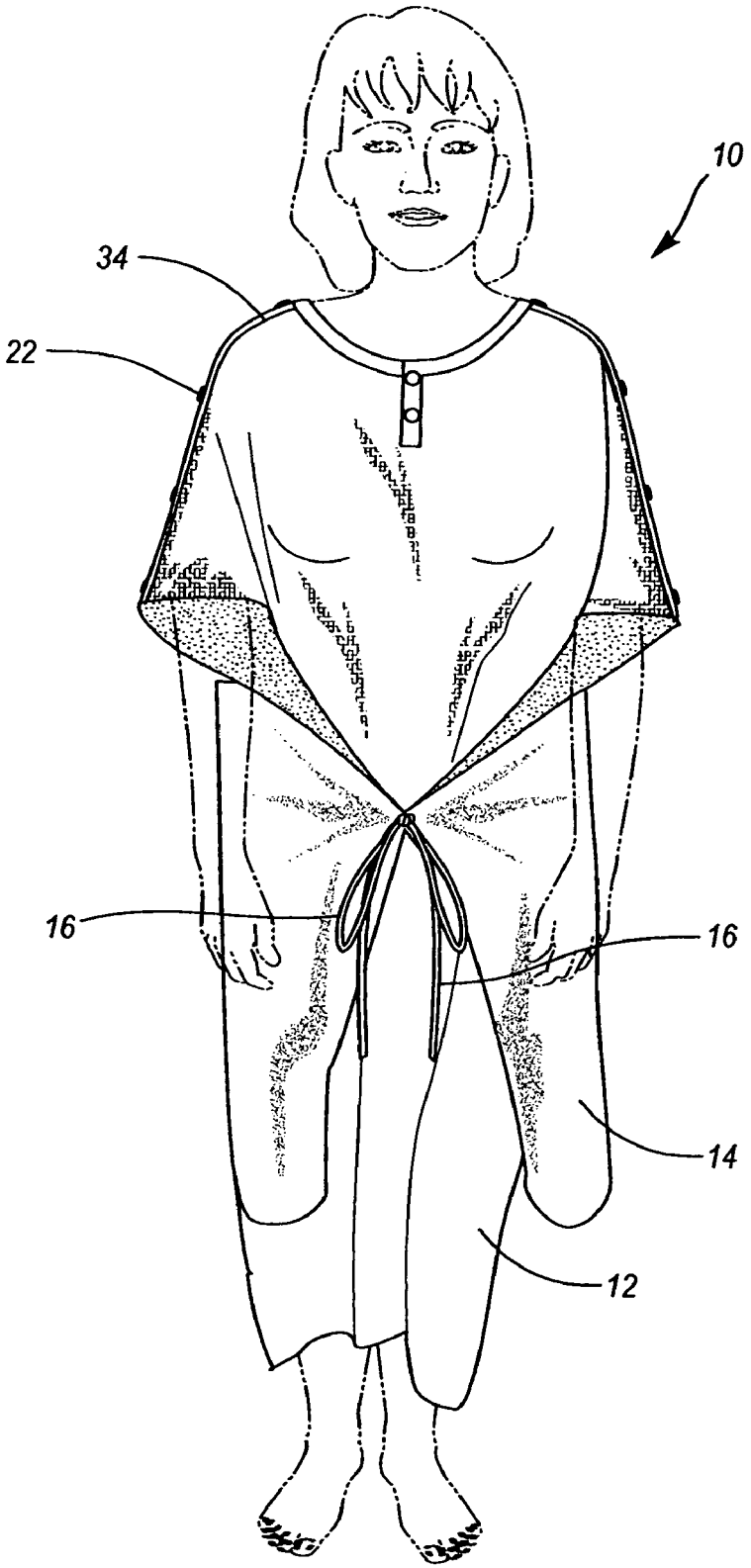
FIG. 5 is a front view of the present invention in place upon a fictional user in a tied position.
Figure 6:
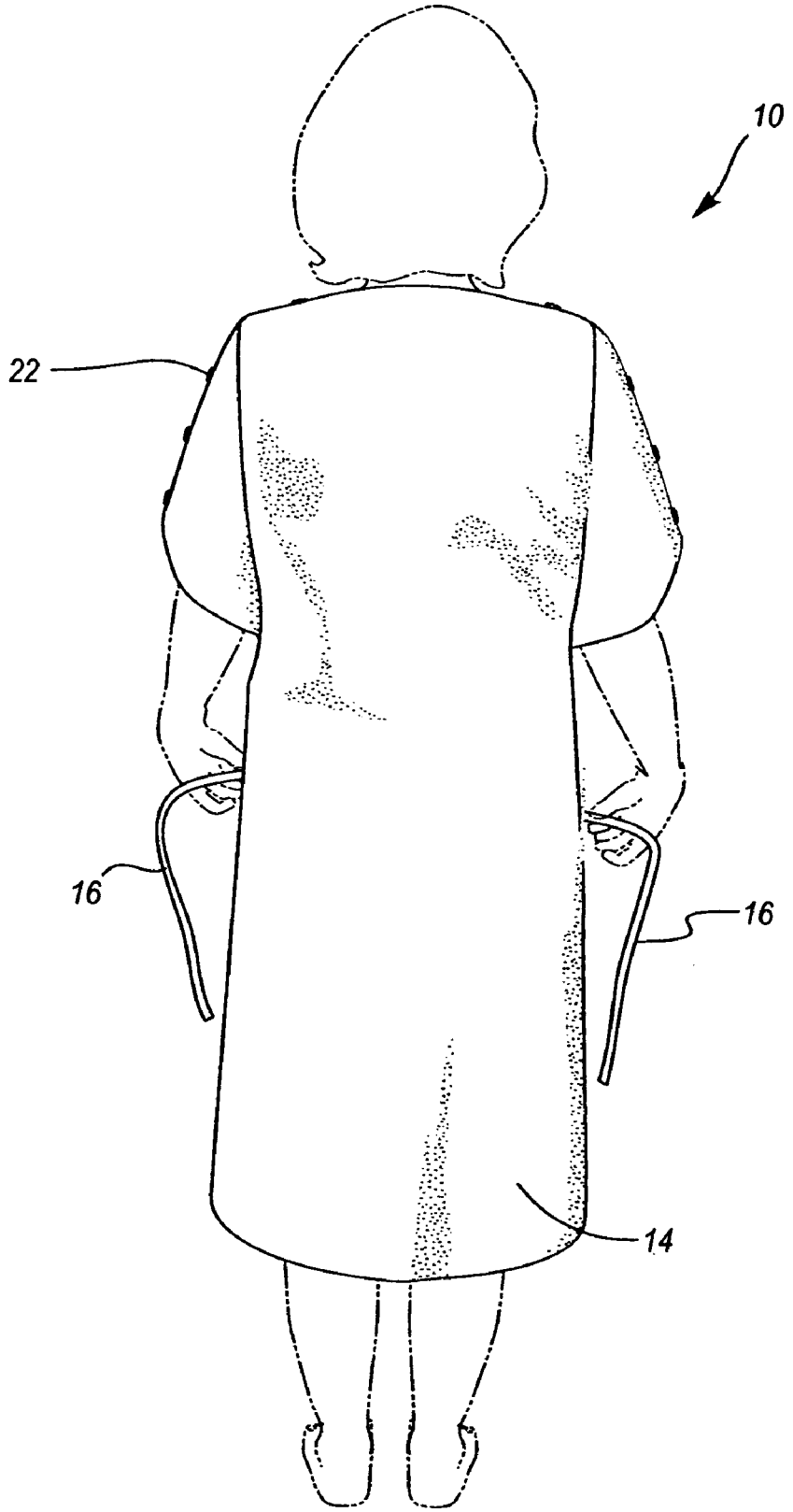
FIG. 6 is a rear view of the present invention in place upon a fictional user in the closed position.

While the invention is susceptible of various modifications and alternative constructions, certain illustrated embodiments thereof have been shown in the drawings and will be described below in detail. It should be understood, however, that there is no intention to limit the invention to the specific form disclosed, but, on the contrary, the invention is to cover all modifications, alternative constructions, and equivalents falling within the spirit and scope of the invention as defined in the claims.

The preferred embodiment of the hospital gown of the present invention is shown in the attached FIGS. 1-8. These drawings show the preferred embodiment of the present invention as well as the use of this invention upon a wearer.

Figure 7:
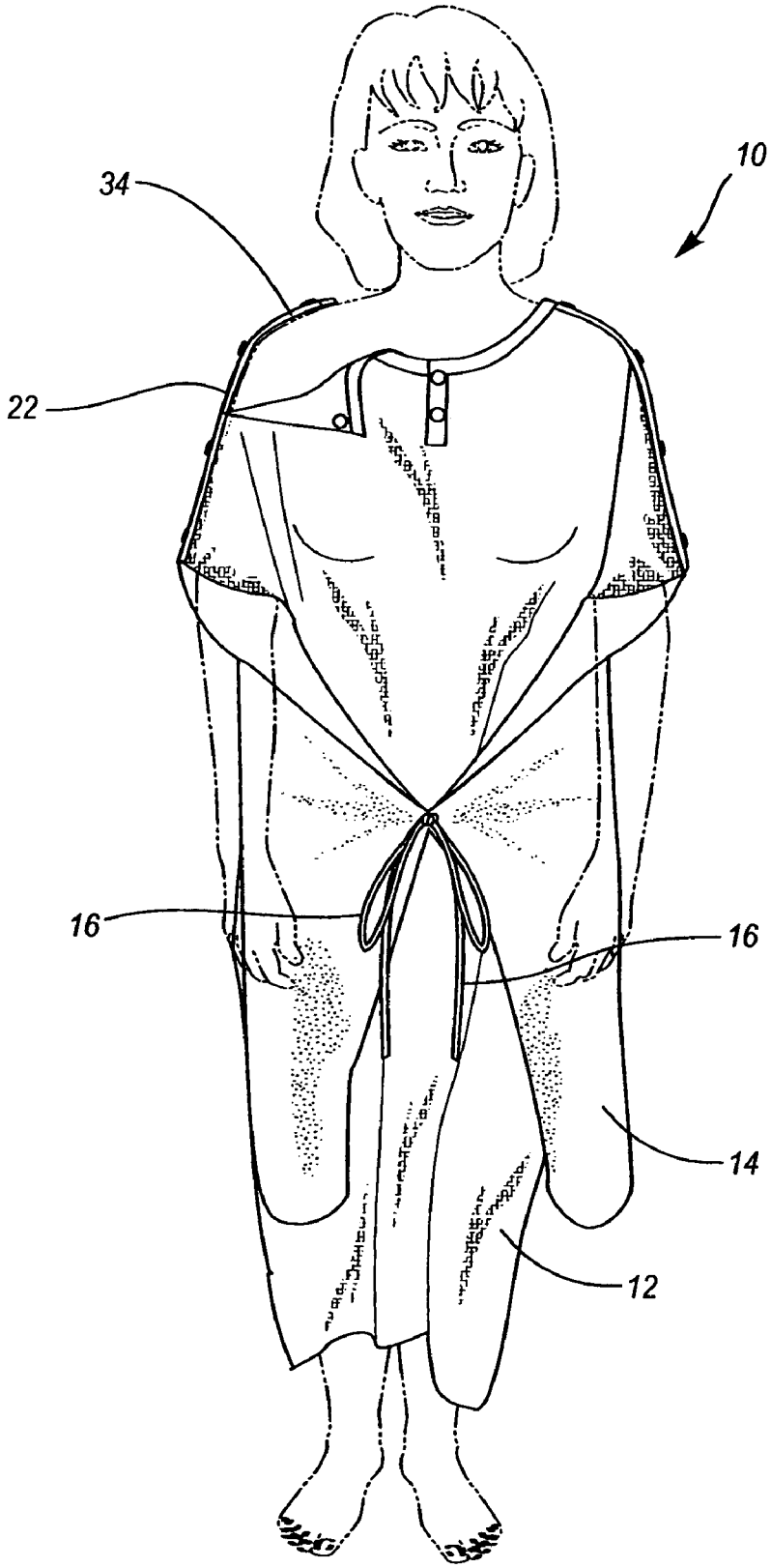
FIG. 7 is a front view of the present invention in place upon a fictional user with the closures of the device fastened in front of the wearer and a portion of the front panel disconnected from the rear portion so as to allow access to a portion of the upper torso of a wearer.
Figure 8:
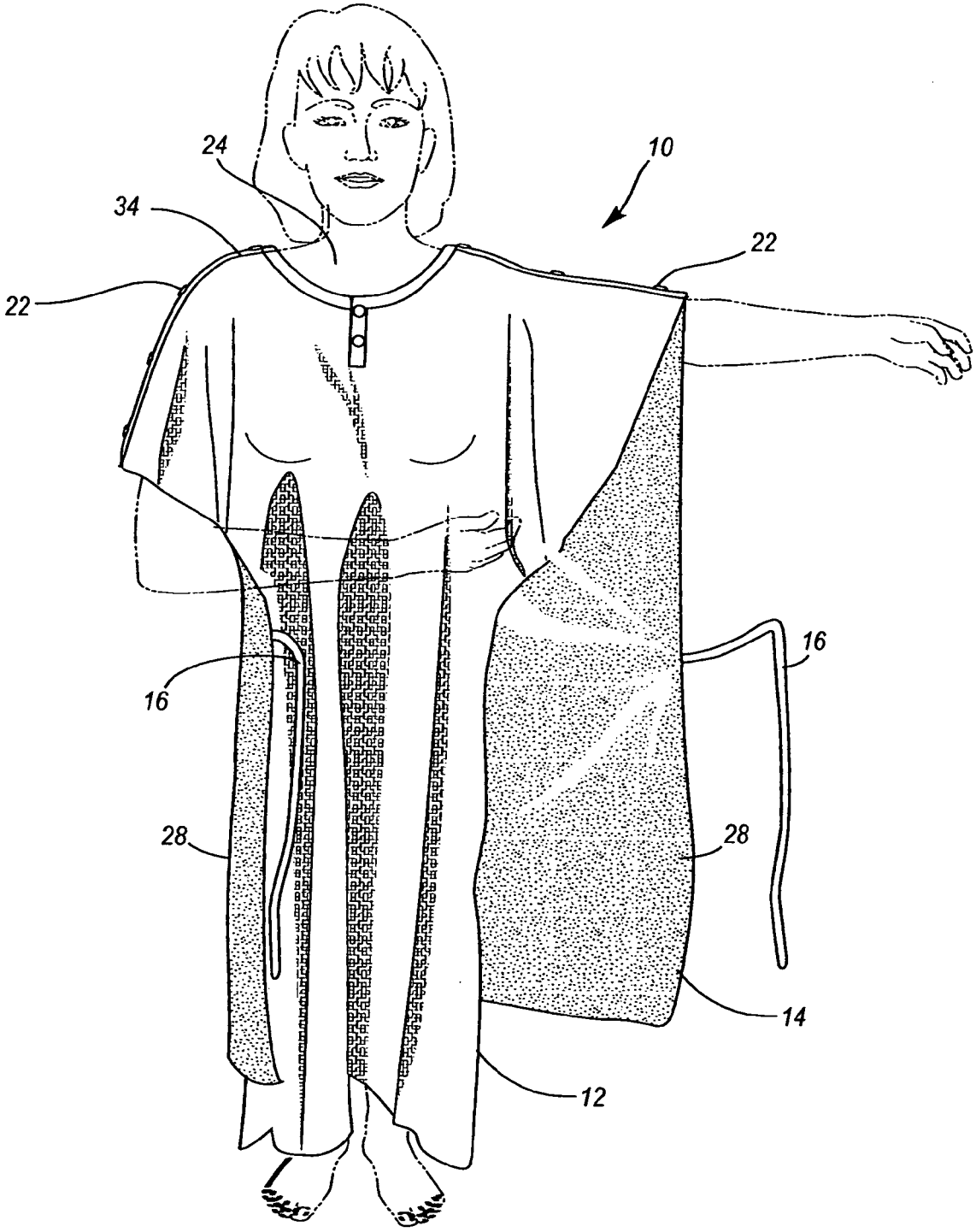
FIG. 8 is a front view of the present invention in place upon a fictional user, who has one armed raised, with the closure devices untied.

Referring now to FIG. 1 a top plan view of the present invention is shown. The present invention 10 is a hospital gown made up of a single one piece front panel section 12, that is releasably connected to a single one piece back panel section 14 along a shoulder seam 34 formed by the uniting of the upper margins of the front and rear panel sections 18, 26 by a plurality of releasable fasteners 22. These releasable fasteners 22 are preferably snap type of releasable closures however it is to be distinctly understood that the invention is not limited thereto but may be variously embodied and configured according to the needs of a user. Other types of acceptable closures include hook and loop fasteners, buttons and other types of known devices. The front and rear panel sections 12, 14 are dimensioned so as to form an opening 24 which is configured to pass over the head of the wearer while the remainder of the gown 10 is dimensioned to cover the shoulders and upper torso of the user. This configuration allows the party wearing the device to maintain a desired level of modesty while still allowing access to the person's body through the sides of the device if necessary, as shown in FIG. 8. Examples of the dimensions and sizing are shown in FIGS. 2-8.

The back panel section 14 is also dimensioned so as to be large enough so as to allow this portion to be wrapped around the posterior of the wearer and to be held in this wrapped position by the closure device 16 which is preferably a tie closure which connects by being tied in front of the wearer. In the preferred embodiment the closure device extends from the lateral margins 28, 28' and is configured to tie in front of the wearer, see FIGS. 5 and 6.

The front and back panels of the device are made from flexible pieces of material. Preferably, this front piece panel section contains a first designating characteristic such as a pattern or color which is substantially different from the second designating characteristic which is found on the back panel section of the device. These two different designating characteristics, colors, patterns, prints or the like, allow the front and back panel sections 12, 14 to be easily identified as to which is the front and which is the back of the gown. This designation assists the wearer of the device in being able to properly place the device upon them and also assists laundry workers in sorting and assembling these items. While the front and back panel sections are described as being single one piece panel sections, this is not to be construed as limiting these sections only to pieces that are cut from one piece of cloth. Rather it is to be distinctly understood that this definition may also be used to describe combinations of pieces of material that are permanently affixed to form one whole piece.

The front and back panel sections 12, 14 together define an opening 24 which is configured to allow a wearer to pass their head through so as to place device upon their body. While one type of opening 24 is shown in the drawings it is to be distinctly understood that the invention is not limited thereto but may be variously embodied according to the needs of the user. In the preferred embodiment the length of the opening 24 may be lengthened or closed by opening or closing a lower neck opening 36 which would be held in place by a suitable fastener.

The upper margin of the front panel section 18 and the upper portion of the back panel section 26 are configured to come together at a shoulder seam 34 which covers the shoulder of the person wearing the device. These two portions 18, 26 are configured to interconnect and are held in place by the releasable fasteners 22. This feature of the present invention provides several advantages. One advantage of this configuration is that it allows the gown to be placed upon a person without having to pass the entire gown 10 over the head of the wearer. Rather persons may place the device upon themselves by so called "side dressing".

In the preferred embodiment of the invention the front panel section of the device is tapered so as to more closely conform to the natural shape of a patient's body. The front panel is wrapped around the patient's side toward the back and the back panel is then brought forward and tied in the front of the patient similar to the way that a conventional bathrobe or other similar type of device is tied. In this same first preferred embodiment, the width of the panels should not extend beyond the patient's elbows so as to not reduce the flexibility and mobility of the patient while wearing the robe.

The present invention allows for placement upon a person through the side of the gown. In order to accomplish this action, the releasable fasteners 22 that hold the front and back portions of the device 12, 14 together are released on one side of the gown. This allows the connected side of the gown to be slid over the arm or body of the person that is to wear the device. After the gown is sufficiently in place the gown may be pulled so as to place the opening 24 around the neck of the wearer and the releasable fasteners 22 that are disconnected may be connected so as to form the robe 10 around the wearer. This is a substantial advantage particularly in working with persons of limited dexterity and flexibility. Such a device allows for various procedures such as bathing and care of the person to take place without having to remove the robe itself in its entirety.

Another advantage of the shoulder seams being releaseably fastened is that it allows quick access to the torso of a wearer in the event of a trauma or code wherein access to the person's torso is immediately required. As is shown in FIG. 7 the front panel portion of the device 12 may be pulled down and away from the back portion 14 so as to allow access to the upper portion of a wearer's torso. In an emergency situation that may be done by simply grabbing and pulling the front of the device with sufficient force so as to separate the front and back panel section 12, 14 along the shoulder seam 34. This allows the medical professional's access to the torso to perform any of the desired or necessary actions that may be required. In addition to these features, the presence of a plurality of releasable fasteners 22 allows the configuration of the gown to be variously modified so as to allow the access of various leads, tubes, and apertures while still allowing the patient to have sufficient comfort, warmth and modesty.

The present invention is a significant improvement over the prior art in that it allows increased functionality and access by a medical professional while providing and maintaining appropriate modesty and warmth to a wearer.

While there is shown and described the present preferred embodiment of the invention, it is to be distinctly understood that this invention is not limited thereto but may be variously embodied to practice within the scope of the following claims. From the foregoing description, it will be apparent that various changes may be made without departing from the spirit and scope of the invention as defined by the following claims.

I claim:

1. A hospital gown comprised of:

a single one piece front panel section made of a flexible material having a first designating characteristic and further comprising an upper margin having a plurality of releasable fasteners connected thereto, said upper margin defining an opening dimensioned to allow passage of said single one piece front panel section over the head of a wearer, said opening being configured to accommodate access to said wearer's chest for diagnostic testing, said single one piece front panel section releasably connected to a single one piece back panel section along an upper margin of said single one piece back panel by said plurality of releasable fasteners;

said single one piece back panel section made of a flexible material having a second designating characteristic, said single one piece back panel section comprised of an upper margin, two side edges, a pair of lateral margins and defining an opening dimensioned to allow passage of said front panel section over the head of a wearer, said single one piece back panel section further having outwardly extending closure ties connected to each of said lateral margins, said single one piece back panel section and said closure ties dimensioned to close said gown around said wearer by connecting said closure ties in front of said wearer when said gown is worn;

said closure ties being further configured to wrap around said front of said wearer so as to enclose said single one piece front panel section;

said single one piece back panel section being further configured such that when said closure ties are tied in front of said wearer, said two side edges are connected to each other in front of said wearer;

said single one piece front panel section and said single one piece back panel section configured so as to be capable of being wholly disconnected from each other.

2. The hospital gown of claim 1 wherein said upper margin of said single one piece back panel section and said upper margin of said single one piece front panel section form a shoulder seam, said shoulder seam connected by at least six releasable fasteners.

3. The hospital gown of claim 1 wherein said single one piece front panel section and said single one piece back panel section are configured to cover the shoulders and upper torso of a wearer when said single one piece front panel section and said single one piece back panel section are connected by said plurality of releasable fasteners.

4. The hospital gown of claim 1 wherein a portion of said opening is selectively closeable by a selectively releasable fastener.

5. The hospital gown of claim 1 wherein said first designating characteristic is a first design and said second designating characteristic is a second design that is different than said first design so that said single one piece front panel section is visually distinguishable from said single one piece back panel section.

6. The hospital gown of claim 1 wherein said first designating characteristic is a first color and said second designating characteristic is a second color that is different than said first color so that said single one piece front panel section is visually distinguishable from said single one piece back panel section.

7. The hospital gown of claim 1 wherein said plurality of releaseable fasteners and said closure ties are the only connecting mechanisms between said single one piece front panel section and said single one piece back panel section.

8. A modest hospital gown comprised of:

a front panel section;

a back panel section having two side edges;

said front panel section and said back panel section configured so as to be capable of being wholly disconnected from each other;

said front panel section and said back panel section each made of a soft flexible material, said front and back panel sections each having a generally V-shaped neck portion configured to allow passage of a person's head therethrough and further configured to accommodate access to a patient's chest for diagnostic testing, said front panel section and said back panel sections connected along a shoulder seam formed by the uniting of said top margins of said front panel section and said back panel section by at least one selectively releasable fastener; and a pair of outwardly extending closure ties, each of said closure ties being fixedly connected to said back panel section, said closure ties configured to connect opposing sides of said back panel section across said front panel section when said gown is placed upon said patient;

said patient having a front and a back;

said closure ties being further configured to wrap around said front of said patient so as to enclose said front panel section;

said back panel section being further configured such that when said closure ties are tied in front of said patient, said two side edges are connected to each other in front of said wearer.

9. The modest hospital gown of claim 8 wherein said front panel section and said back panel sections are selectively releasably connected by compatibly configured snap connection devices.

10. The modest hospital gown of claim 8 wherein said closure ties are connected at approximate mid points of said back panel section.

11. The modest hospital gown of claim 8 wherein said front panel section and said back panel section are connected along said shoulder seam by a plurality of selectively releasable fasteners.

12. The modest hospital gown of claim 8 wherein said front panel section further defines a lower neck opening connected to said generally V-shaped opening portion of said front panel.

13. The modest hospital gown of claim 12 wherein said lower neck opening is selectively closeable by a selectively releasable fastener.

14. The modest hospital gown of claim 8 wherein said selectively releaseable fasteners and said closure ties are the only connecting mechanisms between said front panel section and said back panel section.

15. A modest hospital gown comprised of:

a single one piece front panel section;

a single one piece back panel section having two side edges;

said single one piece front panel section and said single one piece back panel section configured so as to be capable of being wholly disconnected from each other;

said front panel section and said back panel section each made of a soft flexible material, said front and back panel sections each having a generally V-shaped neck portion configured to allow passage of a person's head therethrough and further configured to accommodate access to a patient's chest for diagnostic testing, said front panel section and said back panel sections connected along a shoulder seam formed by the uniting of said top portions of said front panel section and said back panel section by at least one selectively releasable fastener; and a pair of outwardly extending closure ties, each of said closure ties being fixedly connected to said back panel section, said closure ties configured to connect opposing sides of said back panel section across said front panel section when said gown is placed upon said patient;

said patient having a front and a back; and said closure ties being further configured to wrap around said front of said patient so as to enclose said single one piece front panel section;

said single one piece back panel section being further configured such that when said closure ties are tied in front of said patient, said two side edges are connected to each other in front of said wearer.

16. The modest hospital gown of claim 15 wherein said closure ties are connected at approximate mid points of said back panel section.

17. The modest hospital gown of claim 15 wherein said selectively releasable fasteners and said closure ties are the only connecting mechanisms between said single one piece front panel section and said single one piece back panel section.

* * * * *